US006508217B2

(12) United States Patent
Aodai et al.

(10) Patent No.: US 6,508,217 B2
(45) Date of Patent: Jan. 21, 2003

(54) STARTING FUEL SUPPLYING APPARATUS FOR ENGINE

(75) Inventors: Tokihiko Aodai, Toyota (JP); Hisaharu Ishii, Toyota (JP); Yasuhiko Shibata, Hamamatsu (JP)

(73) Assignees: TK Carburettor Co., Ltd., Toyota (JP); Sanshin Kogyo Kabushiki Kaisha, Hamamatsu (JP)

( * ) Notice: Subject to any disclaimer, the term of this patent is extended or adjusted under 35 U.S.C. 154(b) by 78 days.

(21) Appl. No.: 09/851,311

(22) Filed: May 9, 2001

(65) Prior Publication Data

US 2001/0039943 A1 Nov. 15, 2001

(30) Foreign Application Priority Data

May 15, 2000 (JP) ..... 2000-141136

(51) Int. Cl.[7] ..... F02N 17/00
(52) U.S. Cl. ..... 123/179.13; 123/179.15
(58) Field of Search ..... 123/179.13, 179.15, 123/179.16, 179.18, 437, 438, 579, 580; 261/39.2

(56) References Cited

U.S. PATENT DOCUMENTS

| | | | | |
|---|---|---|---|---|
| 3,710,771 A | * | 1/1973 | Cinquegrani | 123/445 |
| 4,475,502 A | * | 10/1984 | Matsumoto | 123/198 D |
| 5,551,385 A | * | 9/1996 | Yoshida et al. | 123/184.21 |

FOREIGN PATENT DOCUMENTS

| | | |
|---|---|---|
| JP | 2-47253 | 12/1990 |
| JP | 7-77059 | 3/1995 |
| JP | 10-26051 | 1/1998 |
| JP | 10-77909 | 3/1998 |

* cited by examiner

*Primary Examiner*—Willis R. Wolfe
*Assistant Examiner*—Mahmoud Gimie
(74) *Attorney, Agent, or Firm*—Stevens, Davis, Miller & Mosher, LLP

(57) ABSTRACT

A starting fuel supplying apparatus improves restarting performance of an engine in a warm-up state. In the engine in which a carburetor is disposed on the side of the cylinder, the starting fuel supplying apparatus and a thermo-sensitive member attached to the carburetor are disposed on the side of the carburetor close to the engine.

2 Claims, 5 Drawing Sheets

STARTING FUEL SUPPLYING APPARATUS FOR ENGINE

FIELD OF THE INVENTION

The present invention relates to a starting fuel supplying apparatus for an engine.

DESCRIPTION OF THE RELATED ART

Heretofore, in a starting fuel supplying apparatus for an engine that has been known, there is provided a starting intake passage which bypasses a throttle valve of a carburetor, in order to enhance the efficiency in the cold start of the engine. A starting fuel passage is connected to the starting intake passage. The starting intake passage is provided with a starting valve, and this starting valve is opened and closed by the expansion and contraction of a thermo-sensitive member. At the cold start of the engine, the starting valve is opened by the contracting of the thermo-sensitive member to supply starting fuel from the starting fuel passage, thereby enhancing the efficiency in the cold start of the engine.

An example of such a starting fuel supplying apparatus for an engine is, for example, disclosed in JP-A-07-77059 as a starting fuel supplying apparatus for an outboard motor. The structure thereof is shown in FIG. 5. On a side of an engine 101, a plurality of carburetors 102 are arranged vertically in line in each cylinder of the engine. On the opposite side of the engine 101 across the centers of the carburetors 102, a starting fuel supplying apparatus 103 and a thermo-sensitive member 104 are provided.

There is also known an outboard motor comprising a plurality of carburetors vertically arranged as mentioned above, in which a starting fuel supplying apparatus and plural thermo-sensitive members are provided and the thermo-sensitive member provided in the uppermost carburetor is projected above the engine.

As shown in FIG. 5 above, the thermo-sensitive members are conventionally disposed on the opposite side of the engine across the centers of carburetors, and therefore, it is difficult to conduct the heat generated by the engine at the warm-up tends to the thermo-sensitive members, so that the temperature of the thermo-sensitive members lower faster than that of the engine when the engine is stopped. This makes the starting valve to be opened unnecessarily widely by the thermo-sensitive member cooled off earlier at the warm-up-state restarting of the engine, and could lead to poor restarting caused by over-richness.

Moreover, in the above outboard motor, a link mechanism 106 which links throttle valves of each carburetor 102 is generally disposed on the opposite side to the engine 101, that is, on the side of a cowling 105 as shown in FIG. 5. Thus, when the starting fuel supplying apparatus 103 and the thermo-sensitive member 104 are disposed on the side of the cowling 105 so as not to interfere with the link mechanism 106, there is a problem that the whole carburetor would become large-sized and the cowling, which covers the engine, would become large-sized.

Furthermore, when the thermo-sensitive member attached to the uppermost carburetor is provided to project above the engine, heat retaining property therein is poorer than that in the thermo-sensitive members attached to the lower carburetors, and this provides poor restarting.

Furthermore, in order to prevent the poor restarting caused by the thermo-sensitive member with its temperature lowered faster than the engine, there is disclosed in JP-Y2-02-47253 a starting apparatus, in which a first heat-retaining cover and a second heat-retaining cover made from synthetic resin with low heat conductivity are disposed doubly with a gap therebetween around the thermo-sensitive member, thereby enhancing heat-retaining property and preventing the thermo-sensitive member from cooling.

However, it is impossible to have satisfactory restarting performance because of insufficient heat-restraining property even with such heat-restraining covers. In addition, as the thermo-sensitive member becomes large-sized because of the heat-restraining covers doubly arranged with the gap therebetween, the whole carburetor becomes large-sized. For example, in the case where a large equipping space for the carburetors cannot be secured in the cowling as in the outboard motor or the like, there is a problem that it would be difficult to equip the carburetor or the cowling would become large-sized.

SUMMARY OF THE INVENTION

An object of the present invention is to provide a starting fuel supplying apparatus for an engine in which the carburetor is disposed on a side of the engine to solve the above problems.

To attain this object, according to a first aspect of the present invention, there is provided a starting fuel supplying apparatus for an engine in which a carburetor is disposed on a side of a cylinder; wherein the carburetor is provided with a starting fuel supplying apparatus comprising: a starting intake passage communicating a main intake passage while bypassing a throttle valve of the carburetor; a starting fuel passage connected to the starting intake passage; a starting valve adapted to open and close the starting intake passage by moving forward and backward in the starting intake passage; and a thermo-sensitive member connected to the starting valve and adapted to control the opening and closing of the starting valve by its expansion and contraction in accordance with ambient temperature, and the thermo-sensitive member is disposed on the side of the carburetor close to the engine.

In the first aspect, as the thermo-sensitive member is disposed on the side of the carburetor close to the engine, it is easy for the thermo-sensitive member to receive the heat from the engine. Therefore, after the engine stops, the thermo-sensitive member is gradually cooled in accordance with the ambient temperature of the engine, and the starting valve opens gradually in accordance with the falling of the ambient temperature of the engine without opening rapidly. In this way, after the engine stops and in a warm-up state, the starting valve has an opening state appropriate for the temperature of the engine. And at the warm-up restart, as the mixture is prevented from becoming over-rich, satisfactory restarting is performed with richness and amount of the mixture required depending upon the condition of the engine.

According to the second aspect of the present invention, an engine is provided with a plurality of carburetors vertically disposed on a side of a cylinder; wherein the carburetors is provided with a starting fuel supplying apparatus comprising: a starting intake passage communicating a main intake passage while bypassing a throttle valve of the carburetors; a starting fuel passage connected to the starting intake passage; a starting valve adapted to open and close the starting intake passage by moving back and forth in the starting intake passage; and a thermo-sensitive member connected to the starting valve and adapted to control the opening and closing of the starting valve by its expansion and contraction in accordance with ambient temperature, and the thermo-sensitive member being disposed on a side of the carburetors close to the engine, and the thermo-sensitive member disposed in the uppermost carburetor being made to project into a cover that covers the upper part of the engine.

In the second aspect, in the case where a plurality of thermo-sensitive members is vertically arranged on the side of the engine, the thermo-sensitive member in the uppermost carburetor is made to project into the cover that covers the upper part of the engine. As a result, the thermo-sensitive member is kept warm by the hot air in the cover remaining due to the heat generated by the engine. In this way, the thermo-sensitive member is cooled gradually in accordance with the ambient temperature of the engine without cooling off rapidly, and the starting valve is controlled in the same way as the first aspect. In this way, at the warm-up restart, as the mixture is prevented from becoming over-rich, satisfactory restarting is performed with richness and amount of the mixture required depending upon the condition of the engine.

The above and further objects and features of this invention will become more apparent from the following detailed description in conjunction with the accompanying drawings.

DETAILED DESCRIPTION OF THE PREFERRED EMBODIMENT

Figure 1:
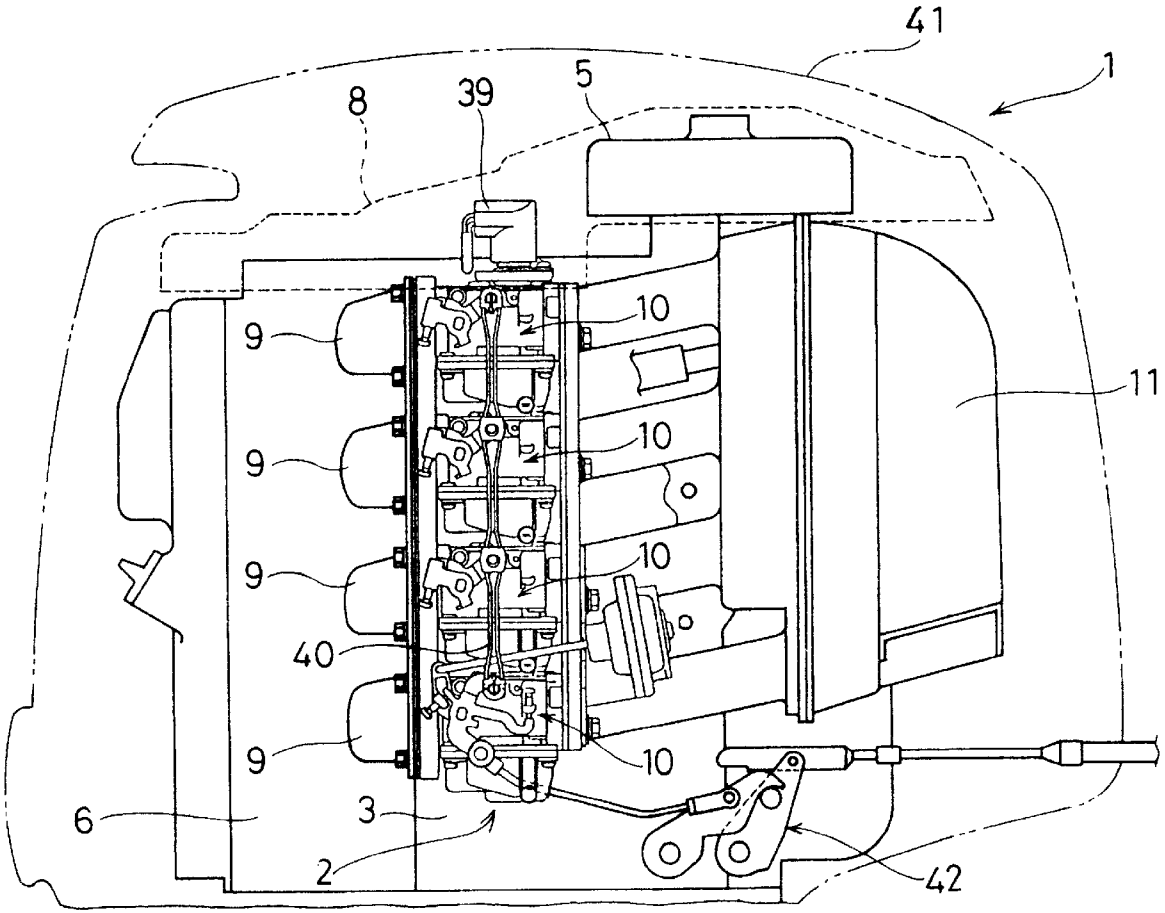
FIG. 1 illustrates an embodiment according to the present invention, and is a side view showing an engine viewed from its side being equipped with carburetors with a starting fuel supplying apparatus of the present invention.
Figure 2:
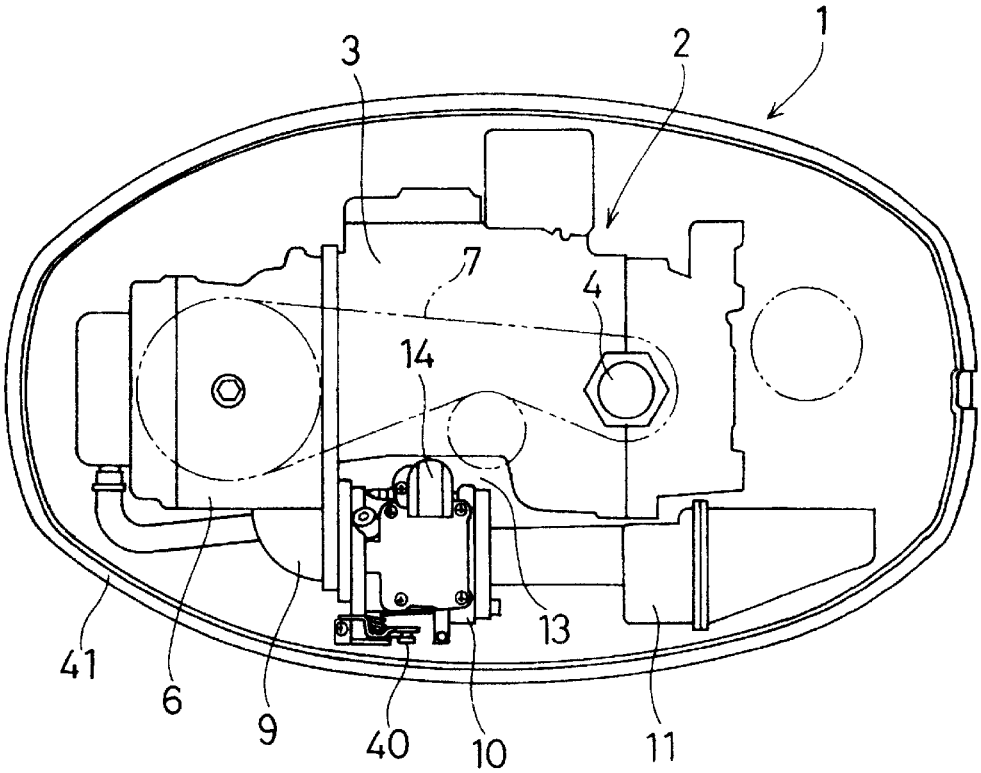
FIG. 2 is an upper view of the embodiment in FIG. 1.

An embodiment according to the present invention will be described with reference to FIGS. 1 to 4 being applied to an outboard motor.

An engine 2 of an outboard motor 1 comprises cylinders 3 constituted by being disposed transversly and arranged vertically in plural numbers (four in the drawing). A crankshaft 4 of the engine 2 is disposed in the vertical direction, and a flywheel 5 is axially fixed to the portion of the crankshaft 4 projecting over the engine 2. The crankshaft 4 and a valve gear (not shown) in a cylinder head portion 6 are made in conjunction by a power conveyer 7. On the upper part of the engine 2, a cover 8 is disposed for covering the flywheel 5 and the power conveyer 7 from above. The cover 8 is formed with a top wall and a side wall.

On the side of the cylinder head portion 6, the same number (four in the drawing) of intake manifolds 9 as the cylinders 3 are disposed vertically in line. The downstream portion of each of the intake manifolds 9 is connected to a not-shown intake port of the engine 2 and the upstream portion extends to the side of the cylinders 3 making curves.

On the side of the cylinders 3, carburetors 10 are disposed. The same number (four in the drawing) of carburetors 10 as the cylinders 3 disposed vertically in line forms linked carburetors. The downstream portion of a throttle valve 17, which is described later, of each carburetor 10 is connected to one of the above mentioned intake manifold 9, respectively. The upstream portion of a main intake passage 15, which is described later, of each carburetor 10 is connected to a silencer (or an air cleaner) 11.

The carburetors 10 are equipped with a starting fuel supplying apparatus 14, which is disposed on the side of the engine 2 of the carburetors 10 and more specifically on the side of the cylinders 3, or in other words disposed in a gap 13 between the carburetors 10 and the cylinders 3 of the engine 2.

The structure of the carburetors 10 and the starting fuel supplying apparatus 14 will be described in detail with reference to FIG. 4.

Figure 4:
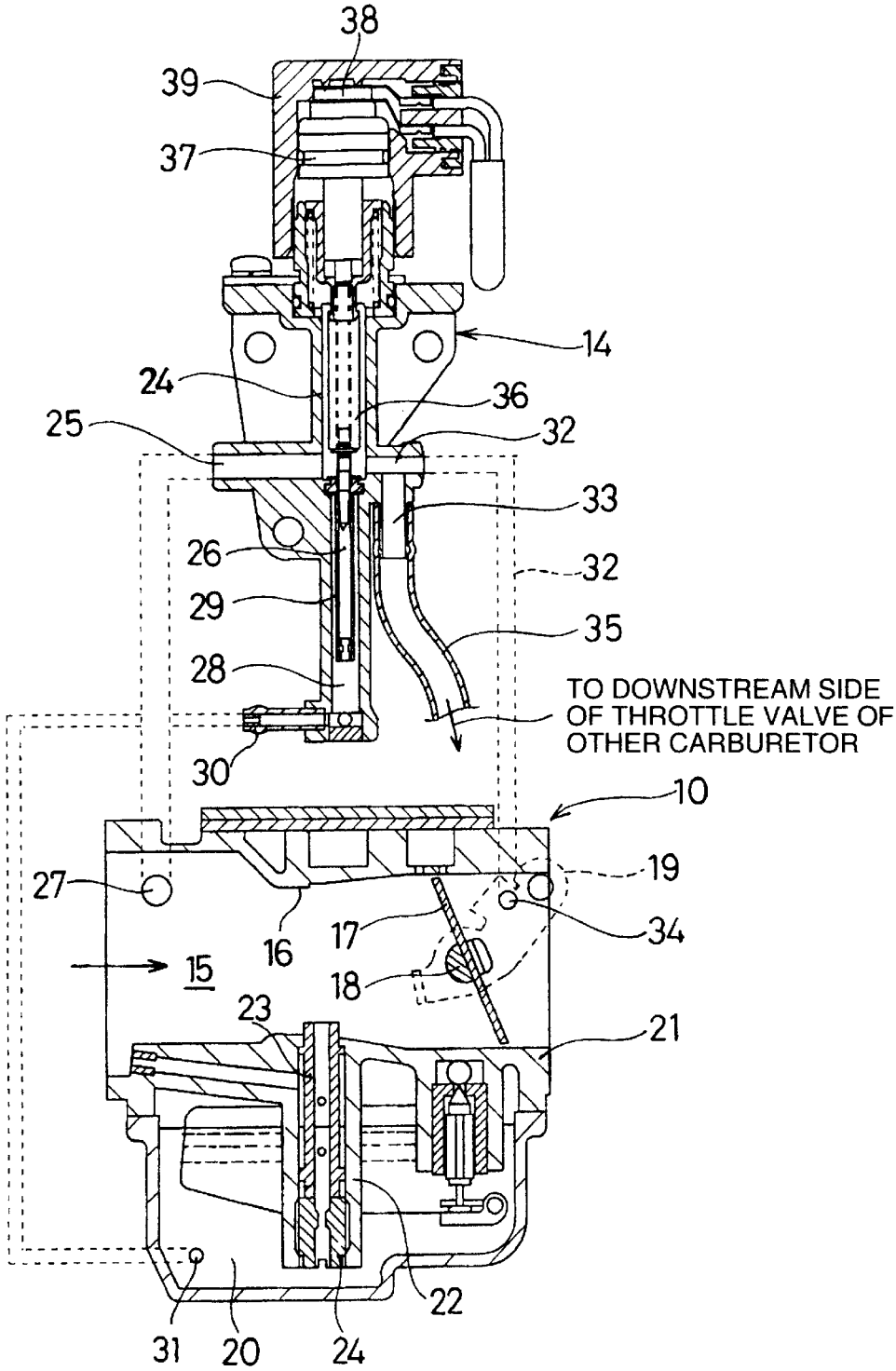
FIG. 4 is a vertical section showing the carburetor and the starting fuel supplying apparatus in the present invention.
Figure 5:
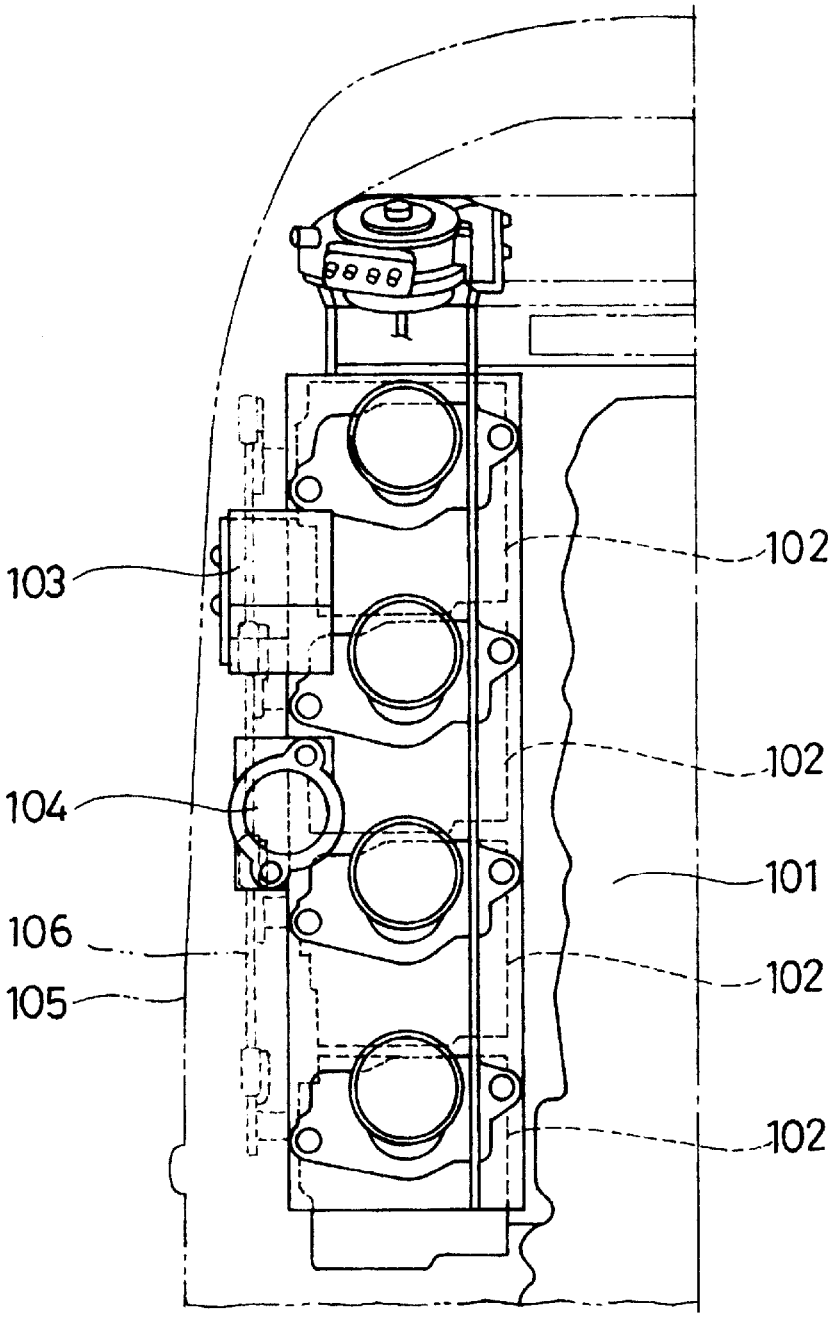
FIG. 5 is a front view showing conventional carburetors, and the right half thereof is omitted.

FIG. 4 illustrates one carburetor 10 and one starting fuel supplying apparatus 14. The carburetor 10 comprises a main intake passage 15 formed by penetrating the carburetor 10, and a venturi 16 is formed in the central part of the main intake passage 15. The throttle valve 17 is disposed on the downstream side of the venturi 16, and a throttle lever 19 is fixed to the outer end of a throttle shaft 18 of the throttle valve 17. The swing of the throttle lever 19 makes the throttle valve 17 open and close. Moreover, the throttle valve 17 is always urged in the closed direction by a not-shown return spring.

Below the main intake passage 15, a fuel chamber 20 is provided. A main nozzle boss 22 projecting into the fuel chamber 20 is provided in a carburetor body 21, and a main nozzle 23 is contained in the main nozzle boss 22. The upper end of the main nozzle 23 is located at the venturi 16 to face the main intake passage 15 and the lower end thereof opens under the oil surface in the fuel chamber 20 through a main jet 24.

Figure 3:
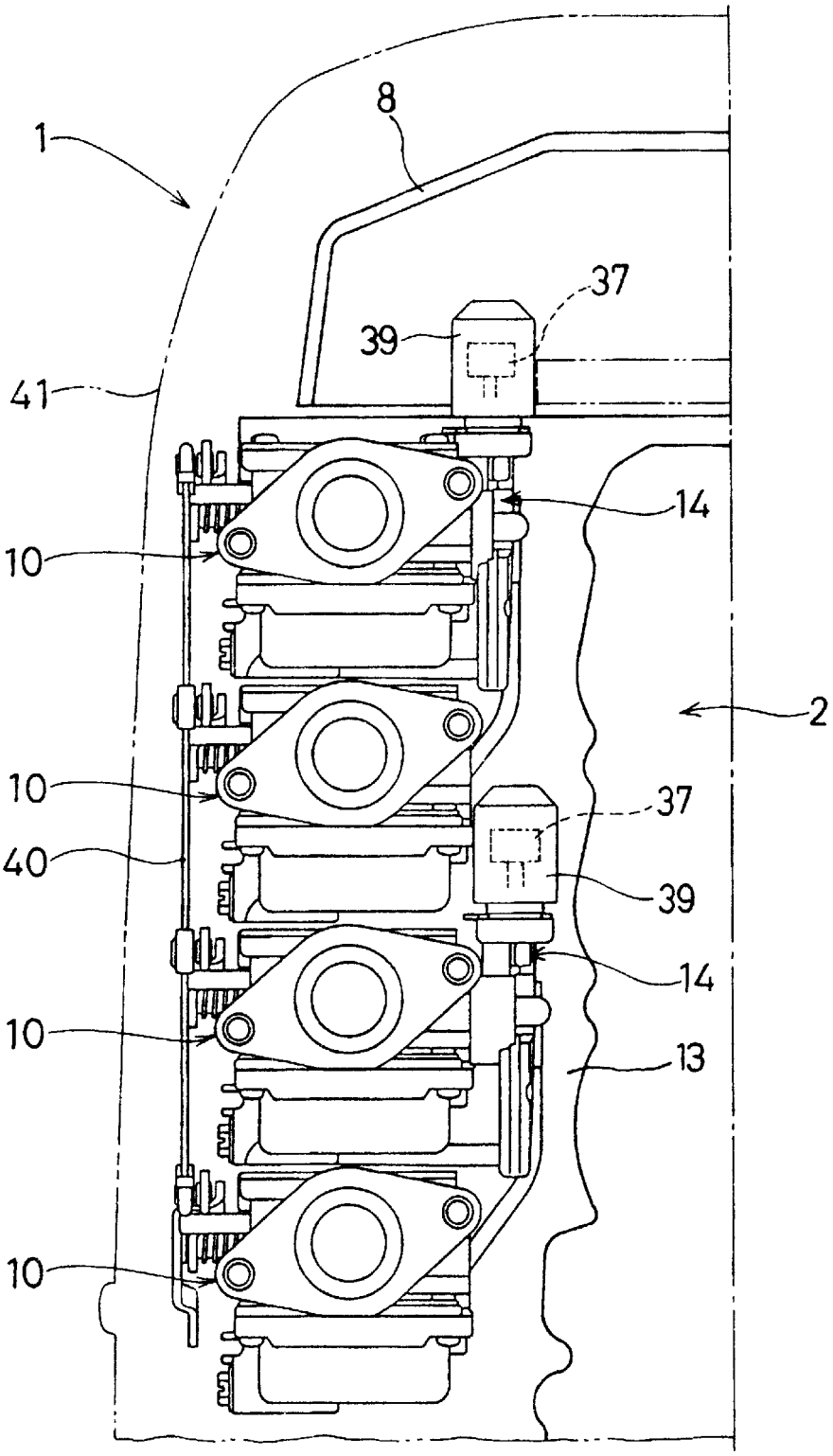
FIG. 3 is a front view showing the engine viewed from the axial direction of a cylinder in FIG. 1, and the right half of which is omitted.

The starting fuel supplying apparatus 14 is provided, as shown in FIG. 3, on the carburetor body 21 of every other carburetor 10 from the uppermost carburetor. As shown in FIG. 4, a starting valve chamber 24 is formed in the starting fuel supplying apparatus 14, and a starting intake passage 25 and a starting fuel passage 26 are connected to the starting valve chamber 24. The starting intake passage 25 is connected, on its upstream side, to the main intake passage 15 on the upstream side of the throttle valve 17 via a port 27. The starting fuel passage 26 is connected to a starting fuel pipe 29 whose lower portion is immersed in the fuel in a starting fuel well 28, and further the starting fuel well 28 is connected via a starter jet 30 to the fuel chamber 20 through a port 31.

At the confluence of the starting intake passage 25 and the upper part of the starting fuel passage 26, a downstream starting intake passage 32 is provided in such a manner as to be connected thereto. The downstream side of the downstream starting intake passage 32 is connected, via a discharge port 34, to the main intake passage 15 on the downstream side of the throttle valve 17 in the carburetor 10 to which the starting fuel supplying apparatus 14 is attached. Furthermore, a branch pipe 33 is formed in the downstream starting intake passage 32, and to this branch pipe 33, another starting intake passage 35 is connected. This starting intake passage 35 is similarly connected, at a downstream side, to the main intake passage on the downstream side of a throttle valve through a discharge port with respect to the next lower carburetor 10*a*.

The starting valve chamber 24 contains a starting valve 36 of a piston type adapted to control opening and closing of the starting intake passages 25, 32 and the starting fuel passage 26. The upper end of the starting valve 36 is connected to a thermo-sensitive member 37 made from wax or the like that expands or contracts in accordance with ambient temperature. When the ambient temperature rises, the thermo-sensitive member 37 expands to push down the starting valve 36, and flow areas of the starting intake passages 25, 32 and the starting fuel passage 26 contract. And, when the ambient temperature drops, the thermo-sensitive member 37 contracts to pull up the starting valve 36, and the flow areas of the starting intake passages 25, 32 and of the starting fuel passage 26 expand.

The thermo-sensitive member 37 is contained in a casing 39 in a contact manner with a heating element 38 which generates heat by electrification due to the running of the engine.

The thermo-sensitive member 37 in the starting fuel supplying apparatus 14 provided in the uppermost carburetor 10 is disposed with a casing 39 thereof to project into the cover 8 which is disposed on the upper part of the engine 2, as shown in FIG. 3. The thermo-sensitive member 37 is kept warm by the hot air remaining in the cover 8.

In the drawing, 40 denotes a link mechanism that links the throttle shafts 18 in the carburetors 10, and it is disposed on the side opposite to the engine 2 in the carburetors 10. 41 denotes a cowling for covering the engine 2 or the like. 42 denotes a throttle operating mechanism.

Next, the function of the forgoing embodiment will be described.

At the point of cold start of the engine 2, the thermo-sensitive member 37 is in a contractive state, and the starting valve 36 connected to the thermo-sensitive member 37 is pulled upward to open the starting intake passages 25, 32 and the starting fuel passage 26. Thus, the intake negative pressure on the downstream side of the throttle valve 17 acts on the starting valve chamber 24 through the discharge port 34 and the downstream starting intake passage 32. Due to the negative pressure, air is sucked from the main intake passage 15 on the upstream side of the throttle valve 17 through the port 27 and the starting intake passage 25, and fuel in the starting fuel well 28 is absorbed from the starting fuel passage 26 into the starting valve chamber 24. The fuel is mixed with the air to be supplied as starting fuel to the downstream side of the throttle valve 17 in the two carburetors 10 through the two starting intake passages 32, 35. Therefore, by adding the starting fuel to fuel from the main nozzle 23, rich mixture best suited for the starting and followed warm-up is supplied to the engine.

After the warm-up, the heating element 38 gets electrified and generates heat, by which the thermo-sensitive member 37 is warmed up and expands. The expansion pushes up the starting valve 36 gradually in accordance with the warm-up state of the engine, and the starting intake passages 25, 32 and the starting fuel passage 26 are closed to stop supplying the starting fuel.

Once the engine 2 stops, the temperature of the engine 2 gradually drops just after the engine 2 stops. At this time, since the thermo-sensitive member 37 is attached to the side of the carburetor 10 close to the engine so as to be disposed close to the cylinders 3 of the engine, the temperature around the thermo-sensitive member 37 becomes equal to the ambient temperature of the engine and the temperature of the thermo-sensitive member 37 is gradually lowered to be approximately equal to the temperature of the engine.

Therefore, after the engine 2 stops and still in the warm-up state, the starting valve 36 is not widely open and has the opening degree appropriate for the temperature of the engine. When the engine is restarted in this warm-up state, restart is not performed with the starting valve 36 unnecessarily opened, but is performed in an proper opening state of the valve, or in other words with the richness and amount best suited for the mixture required by the engine in a particular temperature condition, thereby providing satisfactory restarting performance.

Among the thermo-sensitive members 37, the thermo-sensitive member 37 of the starting fuel supplying apparatus 14 attached to the uppermost carburetor 10 is positioned to project over the engine 2. Therefore, if any measures are not taken, this upper thermo-sensitive member 37 has the lower heat retaining property than the thermo-sensitive members 37 of the starting fuel supplying apparatuses 14 attached to the carburetors 10 that are positioned below. As described above, however, the uppermost thermo-sensitive member 37 is contained with the casing 39 in the cover 8, and therefore the hot air remaining in the cover 8 improves the heat retaining property of this thermo-sensitive member 37, and further the thermo-sensitive member 37 is gradually cooled off as slow as the engine 2, thereby attaining satisfactory control of the starting valve 36 as described above.

In the foregoing embodiment, an example of a linked carburetors is illustrated in which two of the carburetors 10 are paired and the starting fuel supplying apparatus 14 is attached to either one of the carburetors 10 and the starting intake passage 32 on the downstream side of the starting valve 36 diverges to supply starting mixture to the other carburetor 10. However, the starting fuel supplying apparatuses 14 can be attached to each of the carburetors of the linked carburetors, or one starting fuel supplying apparatus 14 can be attached to the linked carburetors to distribute and supply its starting mixture to each carburetor. Moreover, the present invention can be applied to attaching one carburetor to an engine having one or plural cylinders.

As described above, according to the first aspect of the present invention, it is possible to prevent from becoming over-rich at the warm-up restart of the engine and avoid poor restarting.

Furthermore, as the thermo-sensitive member is disposed close to the engine to enhance the heat retaining property of the thermo-sensitive member, it is not necessary to provide the thermo-sensitive member with a heat-retaining cover as conventionally done, and thus, the whole carburetor can be made compact.

Still further, even though a plurality of carburetors are vertically arranged on the side of the engine and a link mechanism is disposed on the opposite side to the engine across the carburetors, the starting fuel supplying apparatus can be positioned without interfering with the link mechanism, which can make the linked carburetors compact.

According to the second aspect of the present invention, as the thermo-sensitive member can be kept warm by the hot air remaining in the cover that covers the upper part of the engine, it is possible to prevent from becoming over-rich at the warm-up restart of the engine and avoid poor restarting, in the same way as the above invention. The preferred embodiments described herein are therefore illustrative and not restrictive, the scope of the invention being indicated by the appended claims and all variations which come within the meaning of the claims are intended to be embraced therein.

What is claimed is:

1. A starting fuel supplying apparatus for an engine in which a carburetor is disposed on the side of a cylinder;

wherein said carburetor is provided with the starting fuel supplying apparatus comprising: a starting intake passage communicating with a main intake passage while bypassing a throttle valve of the carburetor; a starting fuel passage connected to said starting intake passage; a starting valve adapted to open and close said starting intake passage by moving back and forth in said starting intake passage; and a thermo-sensitive member connected to said starting valve and adapted to control the opening and closing of the starting valve by its expansion and contraction in accordance with ambient temperature, said thermo-sensitive member being disposed on a side of the carburetor close to the engine.

2. A starting fuel supplying apparatus for an engine in which a plurality of carburetors are vertically disposed on a side of a cylinder; wherein said carburetors are provided with a starting fuel supplying apparatus comprising: a starting intake passage communicating with a main intake passage while bypassing a throttle valve of the carburetors; a starting fuel passage connected to said starting intake passage; a starting valve adapted to open and close said starting intake passage by moving back and forth in said starting intake passage; and a thermo-sensitive member connected to said starting valve and adapted to control the opening and closing of the starting valve by its expansion and contraction in accordance with ambient temperature, said thermo-sensitive member being disposed on a side of the carburetors close to the engine, the thermo-sensitive member disposed in the uppermost carburetor being made to project into a cover that covers the upper part of the engine.

* * * * *